US006483413B1

(12) United States Patent
Maeda et al.

(10) Patent No.: US 6,483,413 B1
(45) Date of Patent: Nov. 19, 2002

(54) LAMINATED INDUCTOR

(75) Inventors: Eiichi Maeda, Shiga-ken (JP); Katsuhisa Imada, Omihachiman (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/654,112

(22) Filed: Aug. 31, 2000

(30) Foreign Application Priority Data

Sep. 3, 1999 (JP) ..... 11-250319

(51) Int. Cl.[7] ..... H01F 5/00
(52) U.S. Cl. ..... 336/200; 336/83; 336/233
(58) Field of Search ..... 336/200, 83, 233, 336/180

(56) References Cited

U.S. PATENT DOCUMENTS 3,765,082 A * 10/1973 Zyetz ..... 29/602
5,665,819 A * 9/1997 Tenzer ..... 252/62.61
6,183,659 B1 * 2/2001 Murayama et al. ..... 252/62.62

FOREIGN PATENT DOCUMENTS

JP 10-163018 * 6/1998
JP 10-223424 * 8/1998

* cited by examiner

*Primary Examiner*—Elvin Enad
*Assistant Examiner*—Tuyen Nguyen
(74) *Attorney, Agent, or Firm*—Keating & Bennett, LLP

(57) ABSTRACT

A laminated inductor includes a structure and arrangement that allows a synthetic reaction during baking to proceed without problems occurring during plating. The laminated inductor includes magnetic sheets provided with associated coil conductors thereon and a magnetic sheet having no conductor thereon for covering the inductor. The magnetic sheets are prepared by mixing respective powders primarily including $Fe_2O_3$, NiO, ZnO, and CuO. A composition of the powder thus prepared preferably includes about 45 to about 50 mole percent of $Fe_2O_3$, about 5 to about 50 mole percent of NiO, about 0.5 to about 30 mole percent of ZnO, and about 4 to about 16 mole percent of CuO. In addition, about 0.1 to less than about 0.5 percent by weight of $Bi_2O_3$ having a specific surface area of about 10 $m^2/g$ to about 20 $m^2/g$ is added to the powder.

15 Claims, 7 Drawing Sheets

LAMINATED INDUCTOR

BACKGROUND OF THE INVENTION

1. Field of the Invention

The present invention relates to laminated inductors, and more particularly, to a laminated inductor included in a choke coil and other suitable devices.

2. Description of the Related Art

Conventionally, a laminated inductor is produced by laminating a plurality of magnetic layers with a plurality of coil conductors to form a composite body and then baking the composite body, and forming a coil in the composite body by electrically connecting the plurality of coil conductors. In addition, the composite is provided at a surface thereof with input/output external electrodes electrically connected to ends of the coil.

To decrease direct current resistance in a laminated inductor, silver (Ag) has been used as the coil conductor. Accordingly, a material used for magnetic layers must be sinterable at a temperature up to the melting point of the Ag (approximately 960° C.). For this reason, conventionally, to obtain a material used as the magnetic layer material, $Fe_2O_3$, NiO, ZnO, and CuO are mixed together in a ball mill or other suitable device and then calcined. Further, the calcined mixture is pulverized and mixed with a binder, whereby a slurry used as the magnetic layer material is obtained. Alternatively, a sheet made from the slurry by a doctor blade method is used for the magnetic layer. To decrease the calcination and firing temperature, $Bi_2O_3$ is added to the Ni—Zn—Cu system ferrite magnetic material described above. However, since the particle diameter of conventional $Bi_2O_3$ is relatively large (a small specific surface area of 5 to 6 $m^2/g$), it is difficult to handle the $Bi_2O_3$ because the dispersibility thereof is poor when mixed with $Fe_2O_3$, NiO, ZnO, and CuO, and variations tend to occur regarding degree of calcination synthetic reaction and magnetic characteristics after firing. When the amount of $Bi_2O_3$ added is relatively small, particle diameters of the magnetic material after baking are generally not uniform, and when the amount added thereof is increased to make the particle diameters more uniform, magnetic characteristics generally decrease (in particular, inductance is reduced).

In addition, when external electrodes are plated, the plating solution penetrates into the composite and reacts with the coil conductors. As a result, an increase in direct current resistance and degradation of characteristics relating to breakdown voltage between electrodes often occur. Furthermore, a phenomenon (hereinafter referred to as "plating growth") may occur in which a plating layer grows abnormally and extends from edges of the external electrodes onto the surfaces of the composite. As a result, short-circuiting is caused between the external electrodes of a compact laminated inductor and characteristics relating to breakdown voltage between the external electrodes is reduced. Consequently, before performing a plating treatment, countermeasures, such as a glass coating layer provided between the external electrodes, are often necessary.

SUMMARY OF THE INVENTION

To overcome the above-described problems, preferred embodiments of the present invention provide a laminated inductor, in which a synthetic reaction in a magnetic layer is substantially improved during calcination and firing, and the problems encountered by the prior art laminated inductors are eliminated.

The laminated inductor according to a preferred embodiment of the present invention preferably includes a laminated composite body including a plurality of magnetic layers and a plurality of coil conductors, the plurality of coil conductors being electrically connected to define a coil, and external electrodes provided on surfaces of the composite body and connected to ends of the coil, wherein the magnetic layers are made of a Ni—Zn—Cu system ferrite magnetic material including a powder including $Fe_2O_3$, NiO, ZnO, and CuO, to which $Bi_2O_3$ having a specific surface area of about 10 $m^2/g$ to about 20 $m^2/g$ is added by approximately 0.1 to less than about 0.5 percent by weight. The composition of the powder including $Fe_2O_3$, NiO, ZnO, and CuO as major components is preferably about 45 to about 50 mole percent of $Fe_2O_3$, about 5 to about 50 mole percent of NiO, about 0.5 to about 30 mole percent of ZnO, and about 4 to about 16 mole percent of CuO.

Since the $Bi_2O_3$ having a specific surface area of about 10 $m^2/g$ to 20 $m^2/g$ is included in the Ni—Zn—Cu system ferrite magnetic material, even though the amount of the $Bi_2O_3$ is less than that of the conventional $Bi_2O_3$ having a specific surface area of about 5 $m^2/g$ to about 6 $m^2/g$, plating growth from the external electrodes is minimized and eliminated while the magnetic characteristics are greatly improved.

Additionally, when $Mn_2O_3$ is further added by about 0.05 to about 0.3 percent by weight to the powder primarily including $Fe_2O_3$, NiO, ZnO, and CuO, resistivity of the magnetic layer is greatly increased without impairing sintering density, water absorption rate, and initial permeability.

Other features, elements, characteristics and advantages of the present invention will become more apparent from the following detailed description of preferred embodiments thereof with reference to the attached drawings.

DETAILED DESCRIPTION OF PREFERRED EMBODIMENTS

Figure 1:
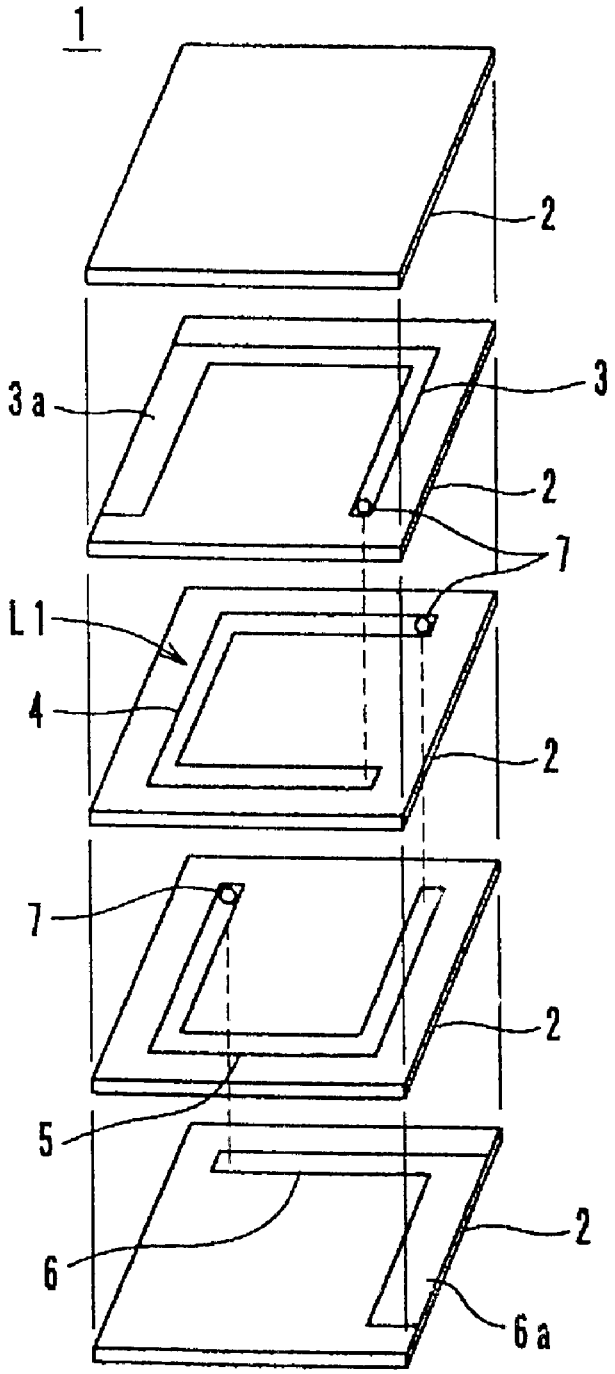
FIG. 1 is an exploded perspective view of a laminated inductor according to a preferred embodiment of the present invention.

Hereinafter, preferred embodiments of a laminated inductor according to the present invention will be described with reference to the accompanying figures. An example of the structure of the laminated inductor of various preferred embodiments of the present invention is shown in FIG. 1. A laminated inductor 1 preferably includes magnetic sheets 2 provided with coil conductors 3 to 6 on the surfaces thereof, and other magnetic sheets 2 having no conductors for covering the magnetic sheets 2 provided with coil conductors 3 to 6. The coil conductors 3 to 6 are provided on the surfaces of the magnetic sheets 2 by printing, sputtering, deposition, or other suitable method. As a material for the coil conductors 3 to 6, silver (Ag), silver-palladium (Ag—Pd), or other suitable material is preferably used.

The coil conductors 3 to 6 are electrically connected in series to each other through via holes 7 provided in the respective magnetic sheets 2 so as to define a spiral coil L1. One end of the coil L1 (that is, a lead portion 3*a* of the coil conductor 3) is exposed at the left side of the magnetic sheet 2, and the other end of the coil L1 (a lead portion 6*a* of the coil conductor 6) is exposed at the right side of the magnetic sheet 2.

The magnetic sheet 2 is produced by mixing desired amounts of various powders (particle diameters thereof ranging from about 0.1 $\mu$m to about 10 $\mu$m) including $Fe_2O_3$, NiO, ZnO, and CuO as major components. In this step, the composition of the powder primarily including $Fe_2O_3$, NiO, ZnO, and CuO is preferably about 45 to about 50 mole percent of $Fe_2O_3$, about 5 to about 50 mole percent of NiO, about 0.5 to about 30 mole percent of ZnO, and about 4 to about 16 mole percent of CuO. When the content of the $Fe_2O_3$ is less than about 45 mole percent, the initial permeability and the inductance value thereof are significantly decreased, and the Q value is also significantly decreased. In contrast, when the content of the $Fe_2O_3$ is more than about 50 mole percent, the sintering density of the magnetic sheet 2 after sintering is decreased, and thus, water and plating solution penetrate into the magnetic sheet. Consequently, the magnetic sheet is not suitable for practical use due to decrease in flexural strength in addition to significant decrease in reliability caused by flux residue. When the content of the NiO is less than about 5 mol percent, the Curie temperature is less than about 100° C., and when the content is more than about 50 mol percent, the inductance value is substantially decreased. When the content of the CuO is less than about 4 mol percent, sintering cannot adequately be conducted, and when the content is more than about 16 mol percent, the resistivity of the magnetic sheet is substantially decreased, such that the magnetic sheet is not suitable for practical use. In addition, when the content of the ZnO is less than about 0.5 mole percent, the inductance value is substantially decreased, and when the content is more than about 30 mole percent, the Curie point is less 100° C.

Next, about 0.1 to less than about 0.5 percent by weight of bismuth oxide as $Bi_2O_3$, having a small particle diameter and a specific surface area of about 10 to 20 $m^2/g$, is added to the powder. When the content of the $Bi_2O_3$ is less than about 0.1 percent by weight, the initial permeability and the inductance value are significantly decreased in addition to the increase in the water absorption rate due to the decrease in the sintering density. When the content of the $Bi_2O_3$ is more than about 0.5 percent by weight, plating growth occurs when the external electrodes are plated.

In this step, when about 0.05 to about 0.3 percent by weight of $Mn_2O_3$ is further added to the powder primarily composed of $Fe_2O_3$, NiO, ZnO, and CuO, resistivity of the magnetic sheet 2 is greatly increased without impairing the sintering density, the water absorption rate, and the initial permeability thereof. The powder added with $Mn_2O_3$ is preferably used in an inductor array having a plurality of inductors (each inductor functions independently from each other) embedded therein because the characteristics relating to breakdown voltage between the inductors adjacent to each other are superior.

This material powder is subsequently mixed with a surfactant and a solvent such as water by a ball mill or other suitable device. The material that is mixed and dispersed is converted into a dry powder by a spray dryer and is then calcined and subjected to synthetic reaction at about 700 to 850° C. The calcined synthetic material is again mixed with a surfactant and a solvent such as water by a ball mill or other suitable and is then pulverized so that the powder has a specific surface area of at least about 5 $m^2/g$. Subsequently, after a slurry is produced by adding a binder or other suitable material to the powder, the magnetic sheet 2 made of a Ni—Zn—Cu system ferrite material is formed from the slurry by a doctor blade method, a printing method, or other suitable method.

Figure 2:
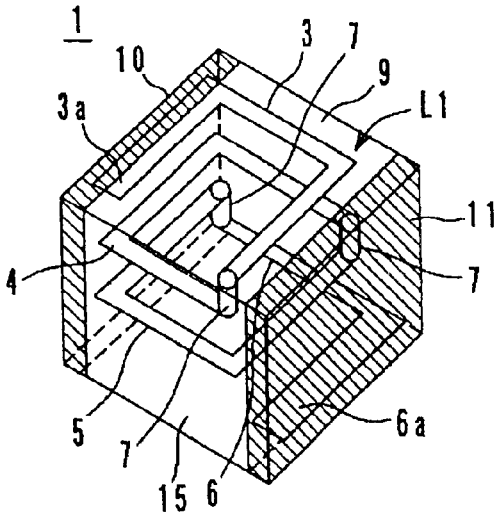
FIG. 2 is a perspective view of the laminated inductor shown in FIG. 1.

The magnetic sheets 2 thus obtained are laminated in order and pressed, as shown in FIG. 1, and they are then fired so as to produce a composite body 15 as shown in FIG. 2. FIG. 2 is a schematic view showing the structure of the laminated inductor 1. Firing conditions such as firing atmosphere, firing time, and other conditions are optionally selected in accordance with the materials used for the magnetic sheets 2, the coil conductors 3–6, and other components of the laminated inductor. In general, the firing temperature is preferably approximately 800° C. to about 930° C., and the firing time is approximately 30 minutes to about 2 hours.

At the left side and the right side of the composite body 15, an input external electrode 10 and an output electrode 11 (shown by the oblique lines in FIG. 2) are provided, respectively, by coating, transferring, sputtering, or other suitable method. As a material used for the external electrodes 10 and 11, Ag, Ag—Pd, Ni, Cu, or other suitable material is preferably used. The input external electrode 10 is electrically connected to one lead portion 3*a* of the coil L1, and the output external electrode 11 is electrically connected to the other lead portion 6*a* of the coil L1. The laminated inductor 1 described above, which is used as a choke coil or other suitable device, is produced.

In the laminated inductor 1, because the Ni—Zn—Cu system ferrite magnetic material is used as a material for the magnetic sheet 2, which includes a powder primarily including $Fe_2O_3$, NiO, ZnO, and CuO, to which $Bi_2O_3$ having a specific surface area of about 10 $m^2/g$ to about 20 $m^2/g$ is added by about 0.1 to less than about 0.5 percent by weight, the materials $Fe_2O_3$, NiO, ZnO, and CuO are homogeneously dispersed with $Bi_2O_3$, so that variations in the degree of calcination synthetic reaction and magnetic characteristics after firing are substantially reduced. In addition, where the external electrodes 10 and 11 are plated, the plating solution does not penetrate into the composite 15, so that an increase in direct current resistance due to a reaction between the plating solution and the coil conductors 3 to 6 is prevented. Furthermore, a so-called plating growth phenomenon is minimized so as to prevent a plating layer from growing abnormally from the edges of the external electrodes 10 and 11 onto the surface of the composite 15.

The laminated inductor of the present invention is not limited to the preferred embodiments described above, and it is to be understood that suitable changes and modifications may be made without departing from the sprit or the scope of the present invention. In the preferred embodiments described above, the magnetic sheets each provided with a pattern formed beforehand are laminated and are then integrally baked. However, the present invention is not limited thereto, and for example, magnetic sheets baked beforehand may be used. In addition, the laminated inductor may be produced by the steps described below.

A magnetic paste material is prepared which includes a Ni—Zn—Cu system ferrite magnetic material comprising a powder primarily including $Fe_2O_3$, NiO, ZnO, and CuO, to which $Bi_2O_3$ having a specific surface area of about 10 $m^2/g$ to about 20 $m^2/g$ is added by about 0.1 to less than about 0.5 percent by weight. Next, after a magnetic layer is formed of the magnetic paste material by printing or other suitable method, a coil conductor is provided on the magnetic layer by coating a conductive paste material. Subsequently, the magnetic paste material is coated over the magnetic layer provided with the coil conductor formed thereon so as to produce a composite of two magnetic layers with the conductive layer provided therebetween. By alternately coating the magnetic paste material and the conductive paste material in a manner similar to that described above, an inductor having a laminated structure is obtained.

EXAMPLES

Powders primarily including $Fe_2O_3$, NiO, ZnO, and CuO were prepared in accordance with compositions 1 and 2 shown below.

Composition 1

$Fe_2O_3$: 47.5 mole percent,

NiO: 38.5 mole percent,

ZnO: 2.0 mole percent, and

CuO: 12.0 mole percent

Composition 2

$Fe_2O_3$: 47.5 mole percent,

NiO: 16.5 mole percent,

ZnO: 28.0 mole percent, and

CuO: 8.0 mole percent

To the two compositions described above, about 0.1 to less than about 2.0 percent by weight of $Bi_2O_3$ (hereinafter referred to as bismuth oxide A) having a specific surface area of about 10 $m^2/g$ to about 20 $m^2/g$ was added, respectively. For comparison, about 0.1 to less than about 2.0 percent by weight of conventional $Bi_2O_3$ (hereinafter referred to as bismuth oxide B) having a specific surface area of about 5 $m^2/g$ to about 6 $m^2/g$ was added to each of the two compositions described above.

The powders were wet-mixed for about 16 hours by a ball mill using water as a solvent, and the obtained mixtures were dried by a spray dryer and were then calcined at approximately 750° C. The calcined mixtures were again mixed with a binder, a slurrying additive, and water as a solvent, and pulverized by a ball mill for about 16 hours to produce slurries. Subsequently, magnetic sheets 2 having a thickness of approximately 50 $\mu$m were produced using the slurries by a doctor blade method. The magnetic sheets 2 were laminated, compressed, and fired. Then, material characteristics were measured, and laminated inductors provided with external electrodes 10 and 11 in which Ag was used as an underlayer electrode and plating Ni and Sn (or solder plating) thereon. Plating growths were measured by on the external electrodes mentioned above.

Figure 3:
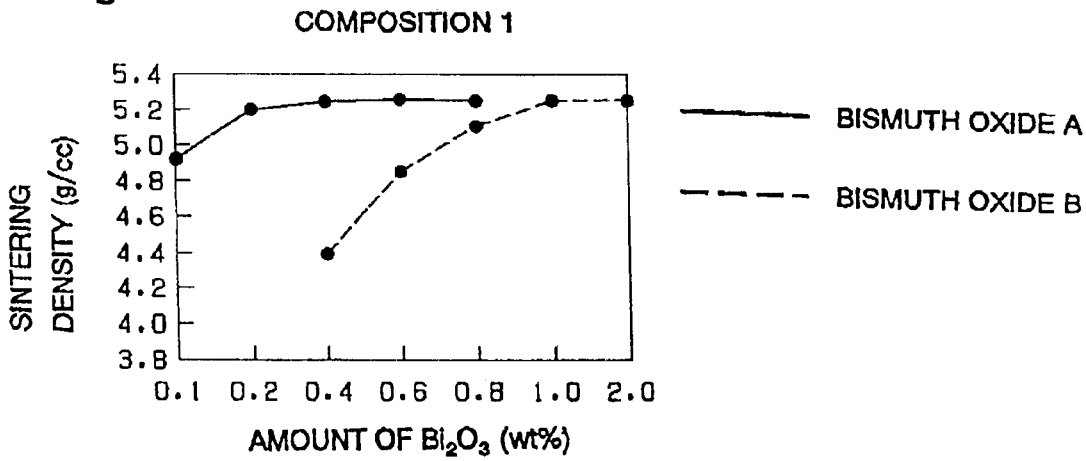
FIG. 3 is a graph showing the relationship between the amount of $Bi_2O_3$ and the sintering density in a composition 1.
Figure 4:
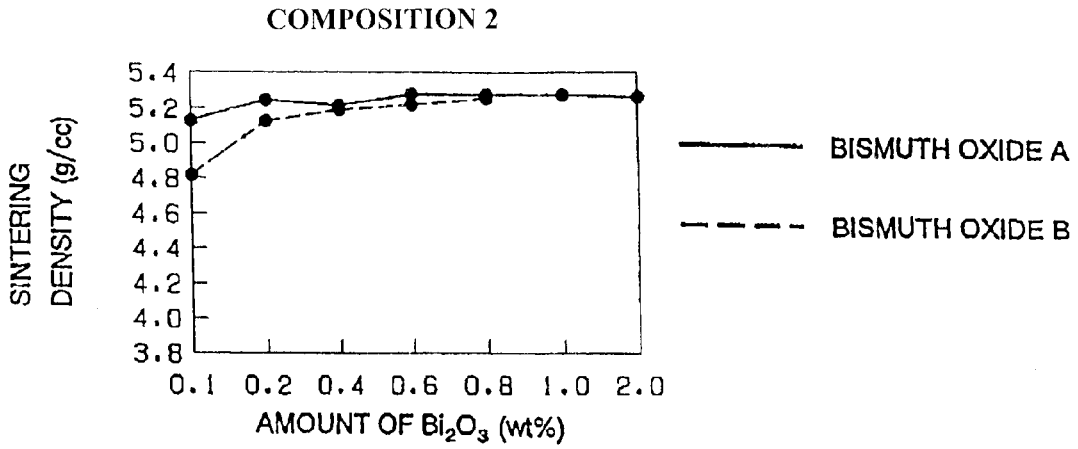
FIG. 4 is a graph showing the relationship between the amount of $Bi_2O_3$ and the sintering density in a composition 2.
Figure 5:
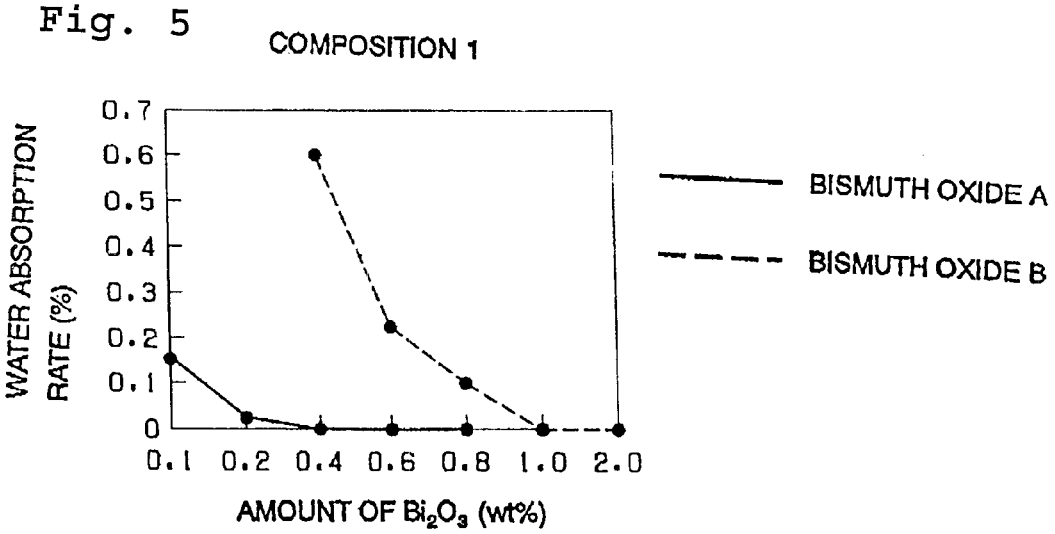
FIG. 5 is a graph showing the relationship between the amount of $Bi_2O_3$ and the water absorption rate in the composition 1.
Figure 6:
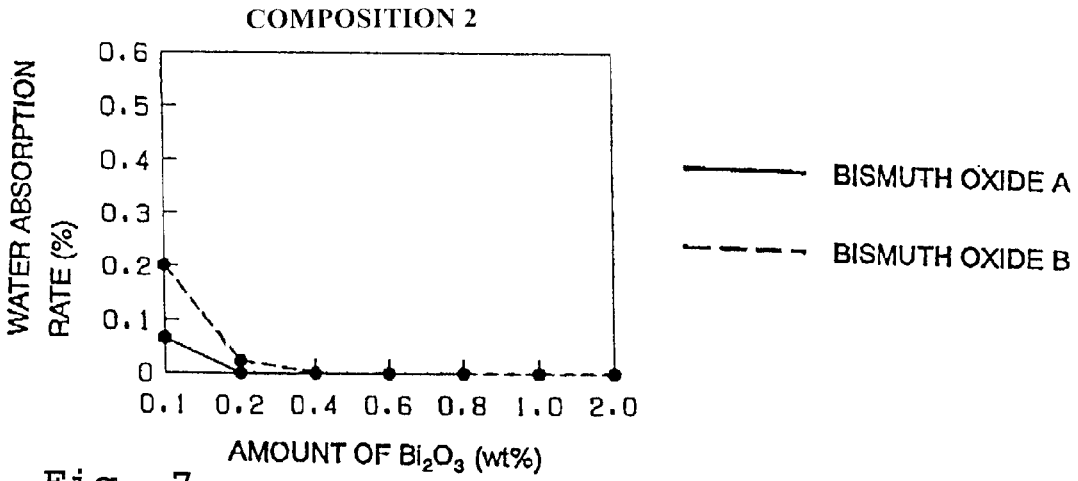
FIG. 6 is a graph showing the relationship between the amount of $Bi_2O_3$ and the water absorption rate in the composition 2.
Figure 7:
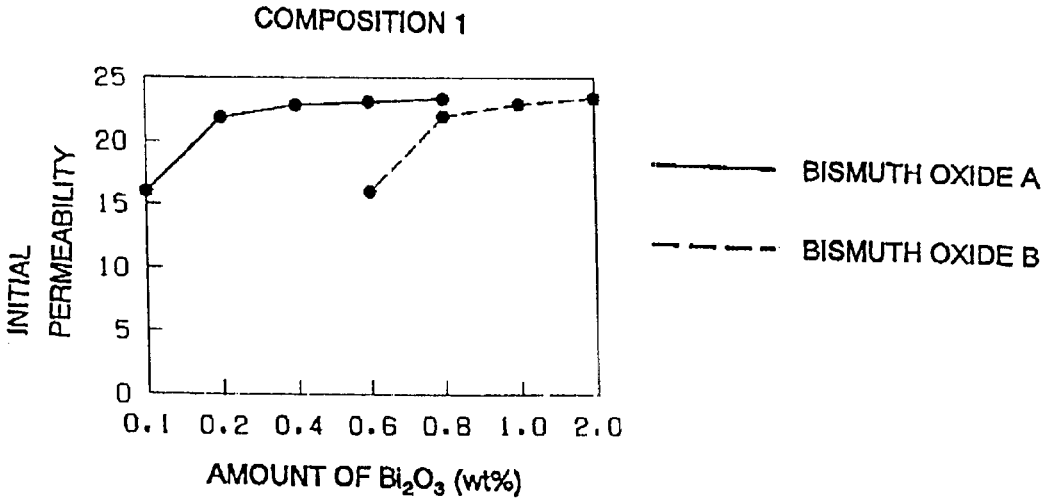
FIG. 7 is a graph showing the relationship between the amount of $Bi_2O_3$ and the initial permeability in the composition 1.
Figure 8:
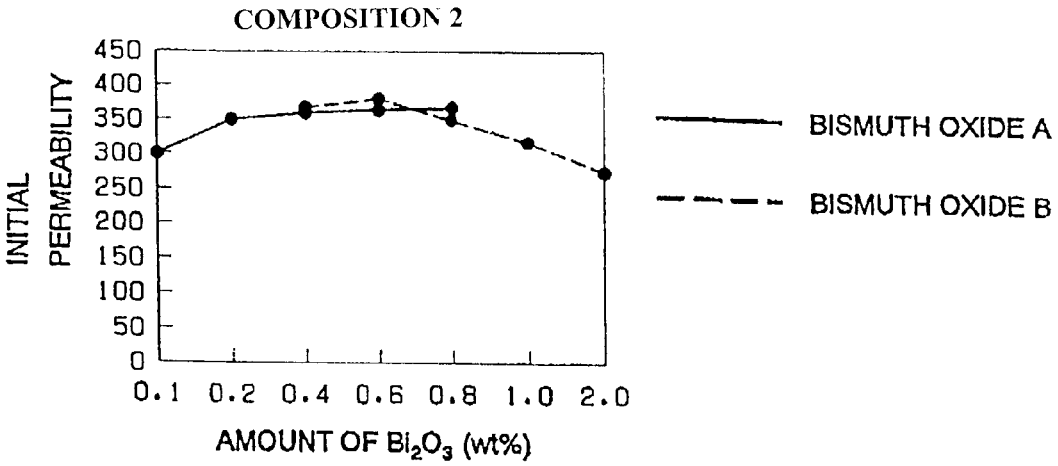
FIG. 8 is a graph showing the relationship between the amount of $Bi_2O_3$ and the initial permeability in the composition 2.
Figure 9:
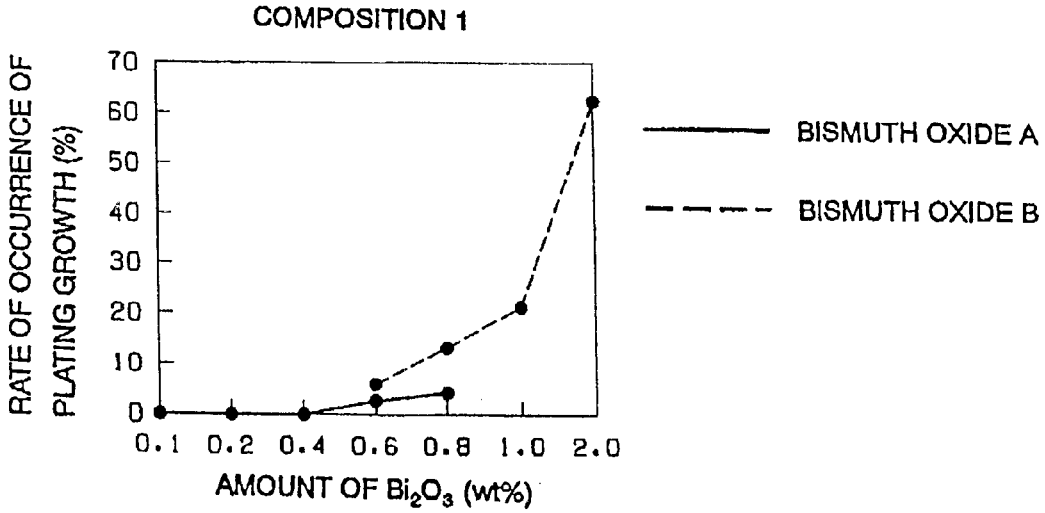
FIG. 9 is a graph showing the relationship between the amount of $Bi_2O_3$ and the rate of occurrence of plating growth in the composition 1.
Figure 10:
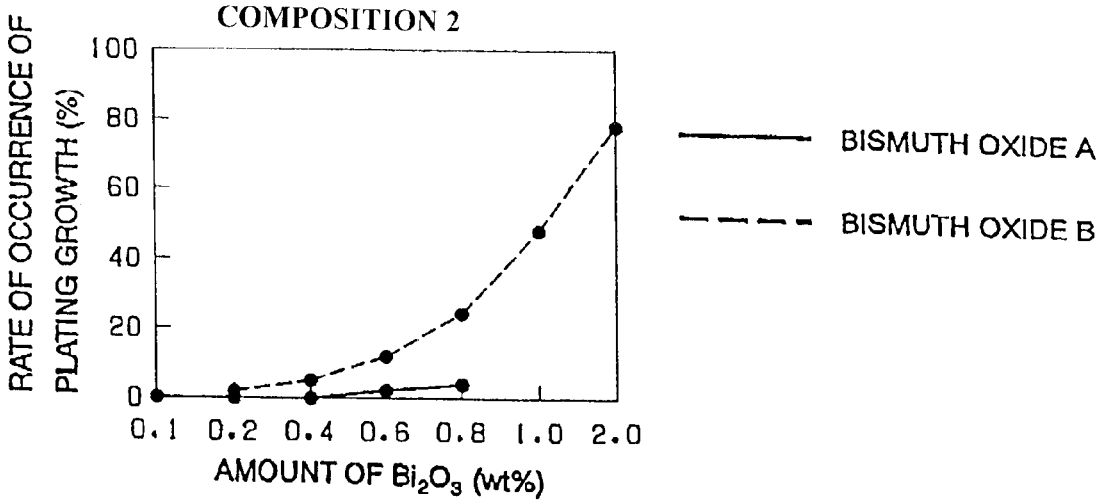
FIG. 10 is a graph showing the relationship between the amount of $Bi_2O_3$ and the rate of occurrence of plating growth in the composition 2.
Figure 11:
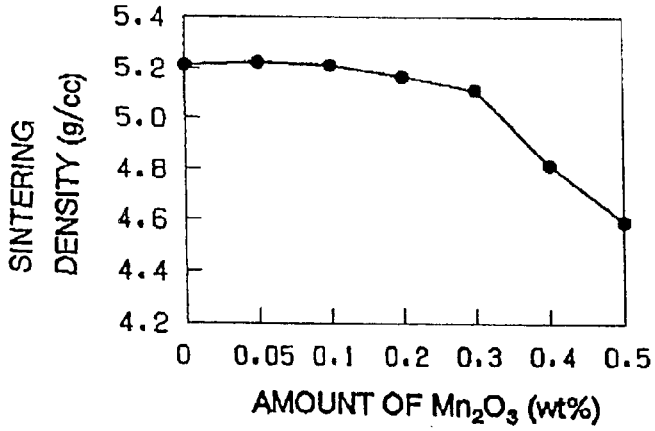
FIG. 11 is a graph showing the relationship between the amount of $Mn_2O_3$ and the sintering density.
Figure 12:
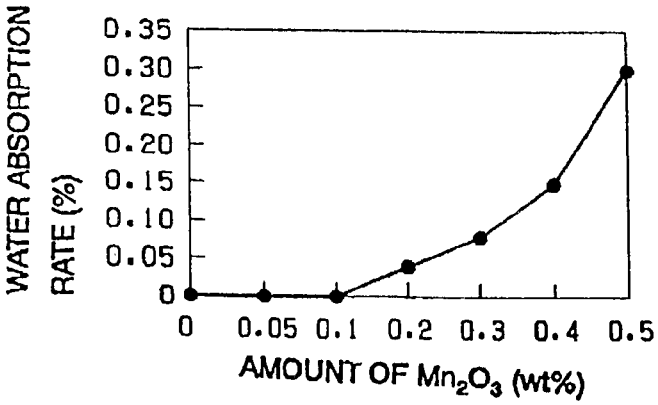
FIG. 12 is a graph showing the relationship between the amount of $Mn_2O_3$ and the water absorption rate.
Figure 13:
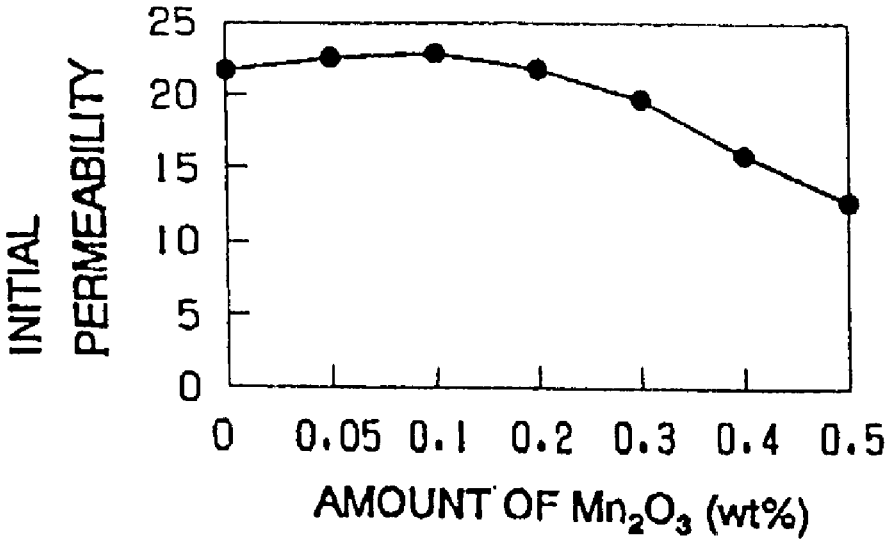
FIG. 13 is a graph showing the relationship between the amount of $Mn_2O_3$ and the initial permeability.
Figure 14:
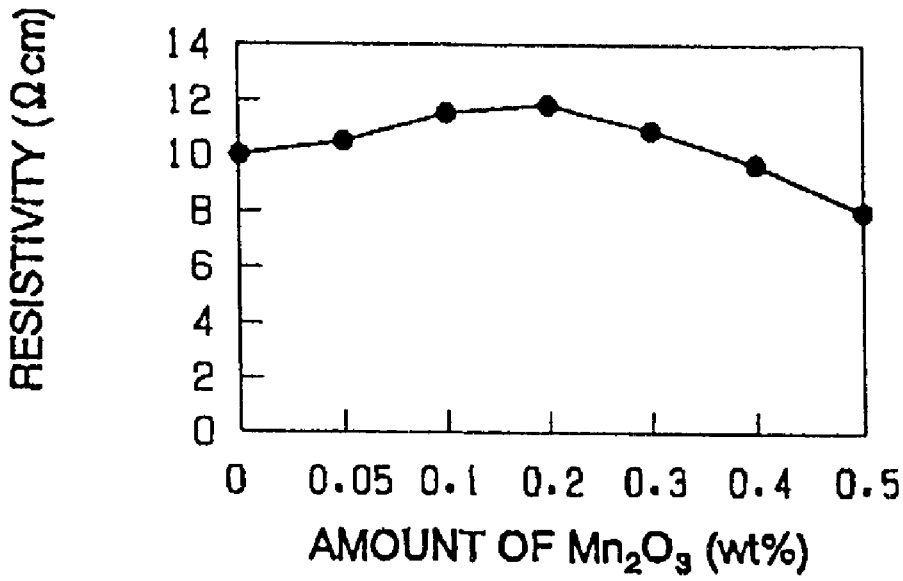
FIG. 14 is a graph showing the relationship between the amount of $Mn_2O_3$ and the resistivity.

FIGS. 3, 5, 7, and 9 are graphs showing the sintering densities, water absorption rates, initial permeabilities, and plating growths of the compositions 1 added with the bismuth oxide A (indicated by a solid line in the figure) compared to those of the compositions 1 added with the bismuth oxide B (indicated by a broken line in the figure). FIGS. 4, 6, 8, and 10 are graphs showing the sintering densities, water absorption rates, initial permeabilities, and plating growths of the compositions 2 added with the bismuth oxide A (indicated by a solid line in the figure) compared to those of the compositions 2 added with the bismuth oxide B (indicated by a broken line in the figure). It is understood that a higher sintering density is better, and as shown in FIGS. 3 and 4, superior characteristics in sintering density were obtained when the bismuth oxide A was added in an amount of at least about 0.1 percent by weight. It is understood that lower water absorption rate is better, and as shown in FIGS. 5 and 6, superior characteristics in water absorption rate were obtained when the bismuth oxide A was added in an amount of at least about 0.1 percent by weight. In addition, it is understood that higher initial permeability is better, and as shown in FIGS. 7 and 8, superior characteristics in initial permeability were obtained when the bismuth oxide A was added in an amount of at least about 0.1 percent by weight. Further, as shown in FIGS. 9 and 10, plating growth started to occur when the content of the bismuth oxide A is about 0.5 percent by weight. Furthermore, when grains were observed at 0.2 percent by weight of the bismuth oxide, the compositions containing the bismuth oxide A had uniform particle diameters, and in contrast, the compositions containing the bismuth oxide B had nonuniform particle diameters.

As described above, since the fine bismuth oxide A (specific surface area is 10 to 20 $m^2/g$) having a larger specific surface area was used as an additive with the Ni—Zn—Cu system ferrite, the plating growths from the external electrodes 10 and 11 of the laminated inductor 1 were eliminated while the characteristics of the Ni—Zn—Cu system ferrite were maintained or improved, even when the amount of the added $Bi_2O_3$ was less than that of the conventional bismuth oxide B (specific surface area is about 5 $m^2/g$ to about 6 $m^2/g$).

FIGS. 11, 12, 13, and 14 are graphs showing sintering densities, water absorption rates, initial permeabilities, and resistivities of the compositions 1 added with the bismuth oxide A and $Mn_2O_3$. As shown in FIGS. 11 to 14, to increase resistivity without impairing sintering density, water absorption rate, and initial permeability, $Mn_2O_3$ may be added in an amount of about 0.05 to about 0.3 percent by weight to the composition.

As is apparent from the description above, according to preferred embodiments of the present invention, since the $Bi_2O_3$ having a specific surface area of about 10 $m^2/g$ to about 20 $m^2/g$ was used as an additive with a Ni—Zn—Cu system ferrite magnetic material, the plating growths from external electrodes is substantially suppressed while the magnetic characteristics of the Ni—Zn—Cu system ferrite were maintained or improved, even when the added amount of the $Bi_2O_3$ was less than that of the conventional bismuth oxide having a specific surface area of about 5 $m^2/g$ to about 6 $m^2/g$. Consequently, the synthetic reaction progresses adequately in the step of calcinating and firing the magnetic layer, and a laminated inductor is obtained in which problems are unlikely to occur during plating.

In addition, by adding $Mn_2O_3$ in an amount of about 0.05 to about 0.3 percent by weight to a powder primarily including $Fe_2O_3$, NiO, ZnO, and CuO, resistivity of the magnetic layer is increased without impairing sintering density, water absorption rate, and initial permeability thereof.

It should be understood that the foregoing description of preferred embodiments is only illustrative of the present invention. Various alternatives and modifications can be devised by those skilled in the art without departing from the invention. Accordingly, the present invention is intended to embrace all such alternatives, modifications and variations that fall within the scope of the appended claims.

What is claimed is:

1. A laminated inductor comprising:

a laminated composite body including a plurality of magnetic layers and a plurality of coil conductors, the plurality of coil conductors electrically connected with each other to define a coil; and an external electrode provided on a surface of the composite body and electrically connected to an end of the coil;

wherein the plurality of magnetic layers includes a Ni—Zn—Cu system ferrite magnetic material including a powder primarily including $Fe_2O_3$, NiO, ZnO, and CuO, to which $Bi_2O_3$ having a specific surface area of about 10 $m^2/g$ to about 20 $m^2/g$ is added by about 0.1 to less than about 0.5 percent by weight.

2. A laminated inductor according to claim 1, wherein the powder comprising $Fe_2O_3$, NiO, ZnO, and CuO as major components is composed of about 45 to about 50 mole percent of $Fe_2O_3$, about 5 to about 50 mole percent of NiO, about 0.5 to about 30 mole percent of ZnO, and about 4 to about 16 mole percent of CuO.

3. A laminated inductor according to claim 1, wherein the powder primarily composed of $Fe_2O_3$, NiO, ZnO, and CuO further includes $Mn_2O_3$ by about 0.05 to about 0.3 percent by weight.

4. A laminated inductor according to claim 1, wherein the powder comprising $Fe_2O_3$, NiO, ZnO, and CuO as major components is composed of about 45 to about 50 mole percent of $Fe_2O_3$.

5. A laminated inductor according to claim 1, wherein the powder comprising $Fe_2O_3$, NiO, ZnO, and CuO as major components is composed of about 5 to about 50 mole percent of NiO.

6. A laminated inductor according to claim 1, wherein the powder comprising $Fe_2O_3$, NiO, ZnO, and CuO as major components is composed of about 0.5 to about 30 mole percent of ZnO.

7. A laminated inductor according to claim 1, wherein the powder comprising $Fe_2O_3$, NiO, ZnO, and CuO as major components is composed of about 4 to about 16 mole percent of CuO.

8. A laminated inductor comprising:

a laminated composite body defined by a plurality of magnetic layers and a plurality of coil conductors, the plurality of coil conductors electrically connected with each other to define a coil; and an external electrode provided on a surface of the composite body and electrically connected to an end of the coil;

wherein the plurality of magnetic layers includes a Ni—Zn—Cu system ferrite magnetic material including a powder primarily composed of $Fe_2O_3$, NiO, ZnO, and CuO, to which $Bi_2O_3$ having a specific surface area of about 10 $m^2/g$ to about 20 $m^2/g$ is added.

9. A laminated inductor according to claim 8, wherein said $Bi_2O_3$ is included by about 0.1 to less than about 0.5 percent by weight.

10. A laminated inductor according to claim 8, wherein the powder comprising $Fe_2O_3$, NiO, ZnO, and CuO as major components is composed of about 45 to about 50 mole percent of $Fe_2O_3$, about 5 to about 50 mole percent of NiO, about 0.5 to about 30 mole percent of ZnO, and about 4 to about 16 mole percent of CuO.

11. A laminated inductor according to claim 8, wherein the powder primarily composed of $Fe_2O_3$, NiO, ZnO, and CuO further includes $Mn_2O_3$ by about 0.05 to about 0.3 percent by weight.

12. A laminated inductor according to claim 8, wherein the powder comprising $Fe_2O_3$, NiO, ZnO, and CuO as major components is composed of about 45 to about 50 mole percent of $Fe_2O_3$.

13. A laminated inductor according to claim 8, wherein the powder comprising $Fe_2O_3$, NiO, ZnO, and cuo as major components is composed of about 5 to about 50 mole percent of NiO.

14. A laminated inductor according to claim 8, wherein the powder comprising $Fe_2O_3$, NiO, ZnO, and CuO as major components is composed of about 0.5 to about 30 mole percent of ZnO.

15. A laminated inductor according to claim 8, wherein the powder comprising $Fe_2O_3$, NiO, ZnO, and CuO as major components is composed of about 4 to about 16 mole percent of CuO.

* * * * *